United States Patent [19]

Smith et al.

[11] Patent Number: 5,006,030

[45] Date of Patent: Apr. 9, 1991

[54] APPARATUS FOR TRANSFERRING REFUSE FROM CONTAINERS INTO REFUSE EQUIPMENT

[75] Inventors: Fred T. Smith; Fred P. Smith, both of Alpine, Utah

[73] Assignee: Waste Management of North America, Inc., Oak Brook, Ill.

[21] Appl. No.: 323,776

[22] Filed: Mar. 15, 1989

[51] Int. Cl.[5] ..... B65F 3/02

[52] U.S. Cl. ..... 414/406; 414/408

[58] Field of Search ..... 414/406, 408, 421, 419, 414/425

[56] References Cited

U.S. PATENT DOCUMENTS

| | | | |
|---|---|---|---|
| 3,016,157 | 1/1962 | Brisson | 414/408 |
| 3,032,216 | 5/1962 | McCarthy | 414/406 |
| 3,702,662 | 11/1972 | Davieau | 414/406 X |
| 3,931,901 | 1/1976 | Jones | 414/406 |
| 4,105,130 | 8/1978 | Hardwick et al. | 414/421 |
| 4,479,751 | 10/1984 | Wyman et al. | 414/406 |
| 4,741,658 | 5/1988 | Zelinka et al. | 414/421 X |

*Primary Excminer*—Sherman Basinger

*Attorney, Agent, or Firm*—Ellsworth R. Roston; Charles H. Schwartz

[57] ABSTRACT

The apparatus of this invention transfers refuse from a container into an opening at the rear end of a hopper in refuse equipment. The apparatus includes first arms pivotable to swing the lower end of the container upwardly. A member cooperates with the first arms to fixedly retain a pin on the container when the first arms have pivoted through a first particular angle. Second arms are then pivoted through a second particular angle to raise the bottom of the container above the lid of the container, while the pin on the container is held at a fixed vertical position, for providing for the transfer of the refuse from the container into the hopper. During such movement, members are moved to effectively raise the lip of the hopper upwardly and to dispose a surface for guiding the transfer of the refuse from the container into the hopper. Members are also provided for gripping the bottom of the container during the pivotal movement of the container upwardly by the second arms. The container may be provided with a detent near its bottom end to facilitate such gripping. This gripping is facilitated by disposing the fulcrum for the pivotal movement of the second arms above, and relatively close to, the fulcrum for the pivotal movement of the first arms. After the transfer of the refuse into the hopper, the second arms are pivoted downwardly through the second particular angle while the pin on the container is held fixedly in position. The first arms are thereafter pivoted downwardly through the first particular angle to return the container to an upright position on the ground.

11 Claims, 7 Drawing Sheets

APPARATUS FOR TRANSFERRING REFUSE FROM CONTAINERS INTO REFUSE EQUIPMENT

This invention relates to apparatus for providing for the transfer of refuse from a container into a hopper in refuse equipment. More particularly, the invention relates to apparatus capable of transferring heavy loads of refuse on a fail-safe basis from large containers into refuse equipments through openings at the rear ends of the refuse equipments.

Containers are disposed at apartment houses, shopping centers, commercial establishments and office buildings to store refuse. These containers can be quite large. For example, some containers may be large enough to store a number of cubic yards of refuse material. Various types of refuse equipment travel on periodic routes to the sites of the containers and transfer the refuse from the containers into storage bodies in such refuse equipments. One common type of refuse equipment is generally designated as a rear end loader. A rear end loader has an opening at its rear end in communication with a hopper. Refuse from the containers is transferred through this opening into the hopper. A packing mechanism in the hopper then operates to transfer the refuse from the hopper into the storage body at the forward end of the refuse equipment.

Different types of apparatus are now in use for transferring refuse from a container into a hopper at of a rear end loader. Such different types of apparatus have certain problems. One problem is that such different types of apparatus are not always safe. For example, such different types of apparatus do not always hold the container firmly on the rear end loader while they operate to lift the container from the ground, pivot the container to a position for transferring refuse into the hopper in the rear end loader and then return the container to a position on the ground. This problem becomes aggravated when the container, and particularly the load of refuse in the container, is heavy. Furthermore, such apparatus is often not capable of lifting the containers, particular with a heavy load of refuse in the containers, and of positioning the containers to transfer the refuse in the containers into the hopper of the refuse equipment.

As will be appreciated, the transfer of refuse from containers into refuse equipments such as rear end loaders occurs quite commonly in the United States and other advanced countries throughout the world. Because of this, a considerable effort has been made, and considerable amounts of money have been expended, to provide apparatus which will be fail-safe, particularly for heavy loads and which will be able to transfer heavy loads of refuse in the containers into the rear end loaders In spite of such efforts and such money, the problems with such apparatus still persist.

This invention provides apparatus for overcoming the problems discussed above. The apparatus provides for a transfer of refuse from a container into a refuse equipment. The apparatus provides this transfer on a fail-safe basis even when the container, and the refuse in the container, are heavy. In this way, operators of the refuse equipment and other persons in the vicinity of the refuse equipment cannot be injured and the transfer of the refuse in the container into the refuse equipment is assured.

One embodiment of the apparatus of this invention transfers refuse from a container into an opening at the rear end of a hopper in a refuse equipment such as a rear end loader. The apparatus includes first arms pivotable to swing the lower end of the container upwardly. A member cooperates with the first arms to fixedly retain a pin on the container when the first arms have pivoted through a first particular angle.

Second arms are then pivoted through a second particular angle to raise the bottom of the container above the lid of the container, while holding the pin on the container at a fixed vertical position, for providing for the transfer of the refuse from the container into the hopper. During such movement, members are moved to effectively raise the lip of the hopper upwardly and dispose a surface for guiding the transfer of the refuse from the container into the hopper.

Members are also provided for gripping the bottom of the container during the pivotal movement of the container upwardly by the second arms. The container may be provided with a detent near its bottom end to facilitate such gripping. This gripping is facilitated by disposing the fulcrum for the pivotal movement of the second arms above, and relatively close to, the fulcrum for the pivotal movement of the first arms.

After the transfer of the refuse into the hopper, the second arms are pivoted downwardly through the second particular angle while the pin on the container is held fixedly in position. The first arms are thereafter pivoted downwardly through the first particular angle to return the container to an upright position on the ground.

IN THE DRAWINGS

Figure 5:
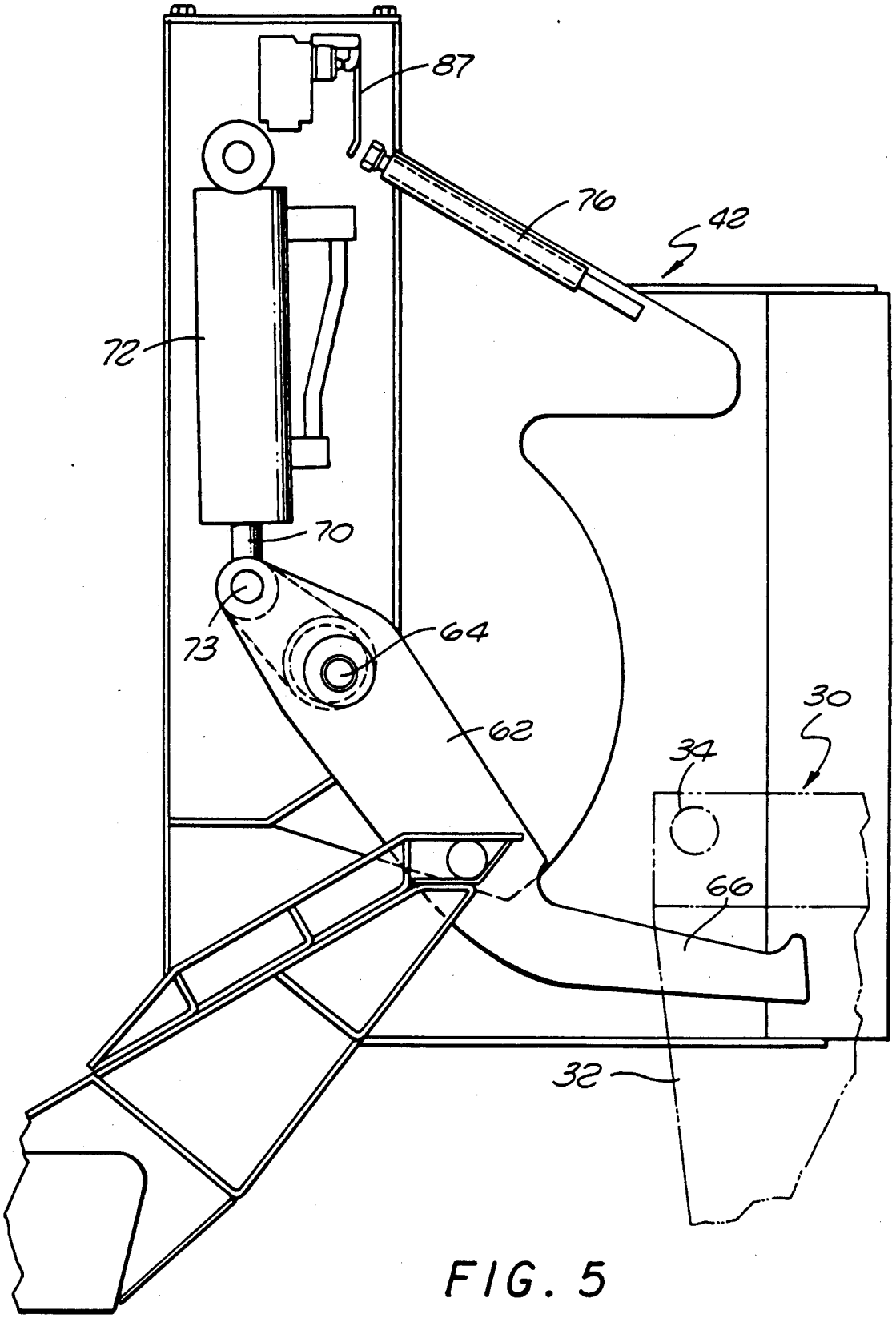
FIG. 5 is an enlarged side elevational view of the apparatus of this invention with certain members removed to show other members in additional detail and with members in the apparatus in position for receiving the container.
Figure 6:
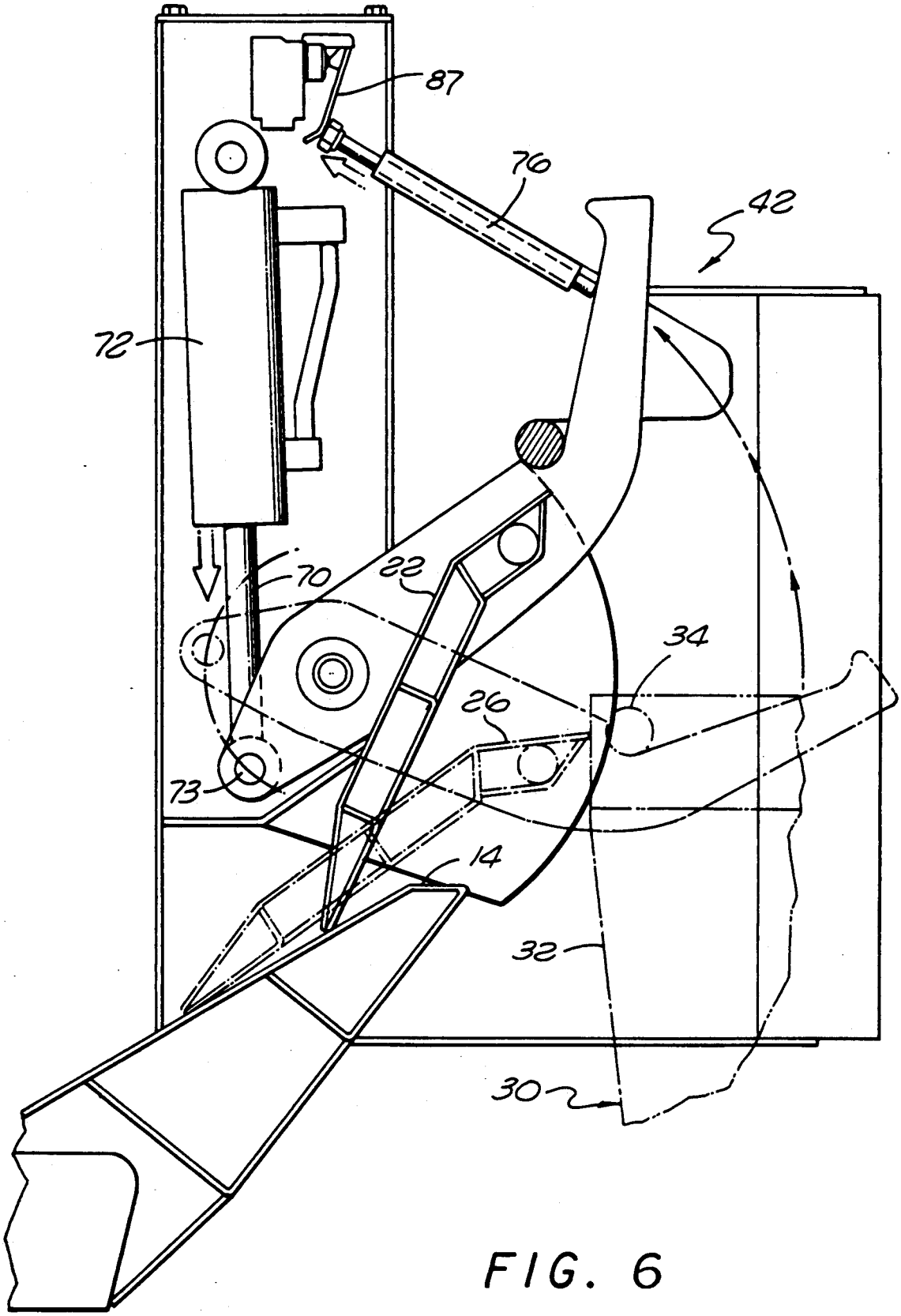
Figure 7:
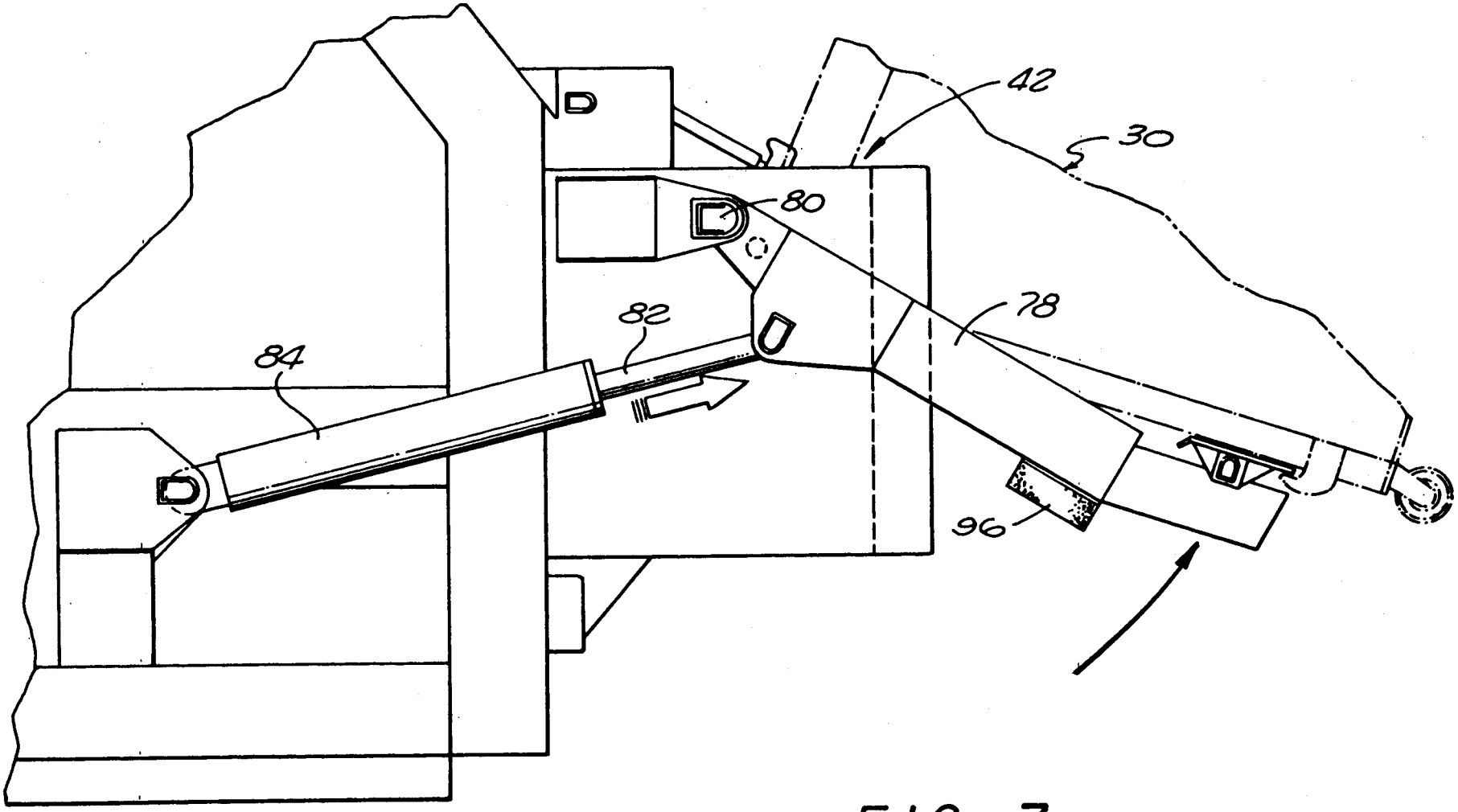
Figure 8:
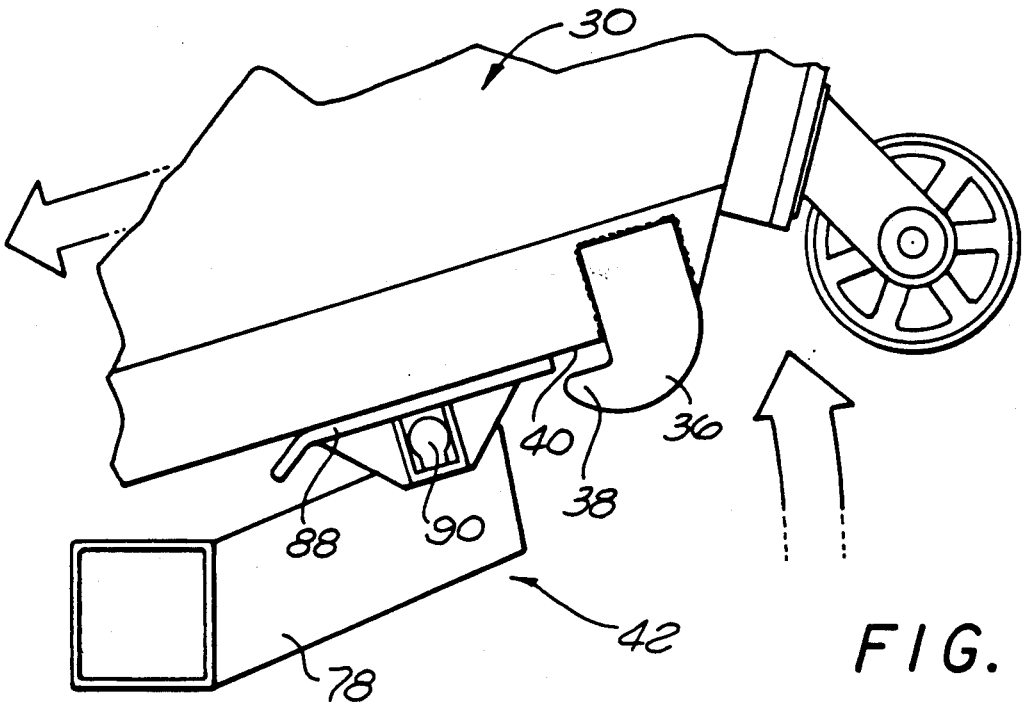
Figure 9:
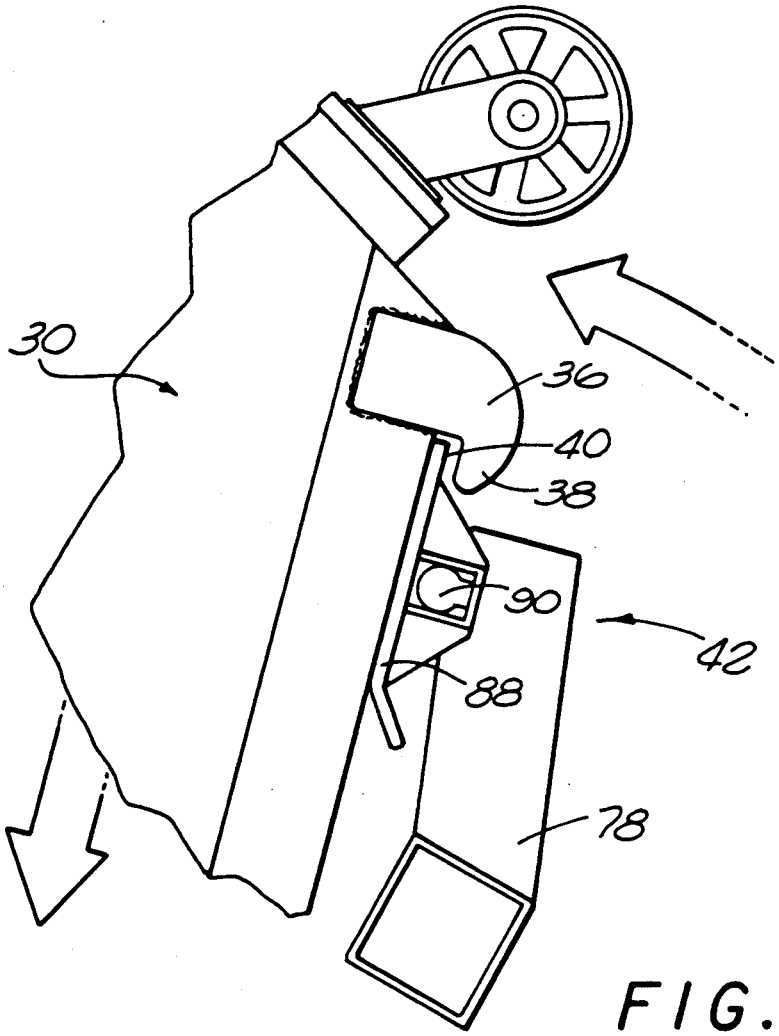
Figure 10:
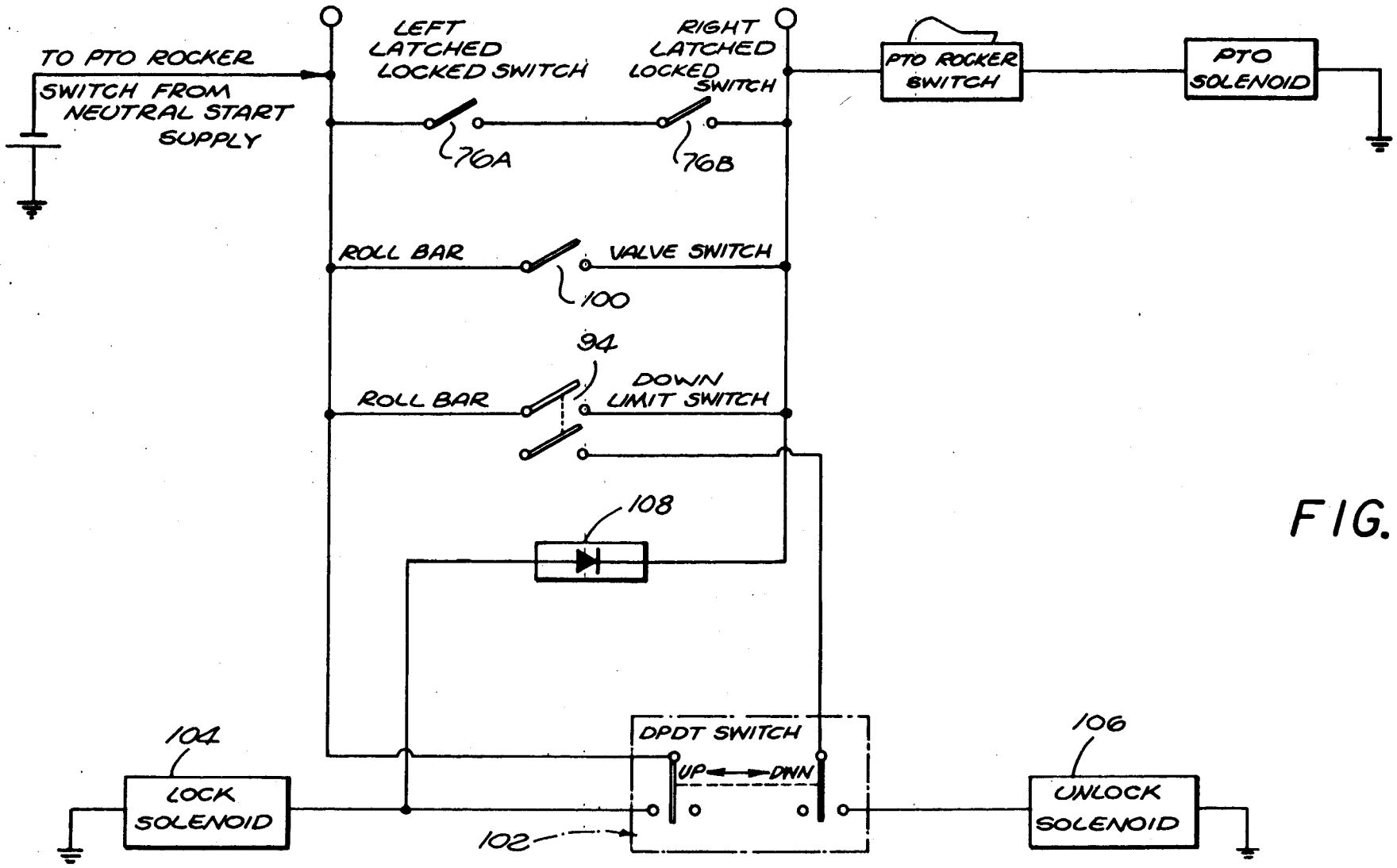

FIG. 6 is an enlarged fragmentary side elevational view similar to that shown in FIG. 5 and illustrates in solid lines the position of members in the apparatus for holding the pin on the container in fixed position and for guiding the refuse in the container into the storage body and further illustrates in broken lines the disposition of such members at an intermediate position relative to the showings in solid lines in FIG. 6;

FIG. 7 is an enlarged fragmentary side elevational view of the container and other members in the apparatus of this invention with such members in position for providing for the transfer of the refuse in the container into the hopper;

FIG. 8 is an enlarged fragmentary side elevational view of certain of the members shown in FIG. 7 and illustrates these members in additional detail with the members at an intermediate position between their normal disposition and their position, as shown in FIG. 7, for transferring the refuse in the container into the hopper;

FIG. 9 is an enlarged fragmentary side elevational view, similar to that shown in FIG. 8, with the members in the position for transferring the refuse in the container into the hopper; and FIG. 10 is a circuit diagram of electrical features in one embodiment of the invention.

In one embodiment of the invention, a refuse equipment generally indicated at 10 may be provided with a well known construction. The refuse equipment 10 may be provided with an opening 12 at its rear end to provide for the transfer of refuse through the opening into a hopper 14 at the rear end of the refuse equipment. The bottom of the opening 12 may be defined by a hopper sill 16. The refuse equipment 10 may be considered to be a rear end loader.

For the purposes of this invention, an additional sill 18 may be disposed on the hopper sill 16 to raise the vertical level of the sill. The additional sill 18 may be disposed at the end of a guide structure 22. The gu:,de structure 22 is movable upwardly from a position indicated in broken lines at 26 in FIG. 6 to the position indicated in solid lines in that Figure. In the position indicated in solid lines in FIG. 6, the guide structure 22 guides the movement of refuse into the hopper 14 from an inverted container generally indicated at 30.

Figure 1:
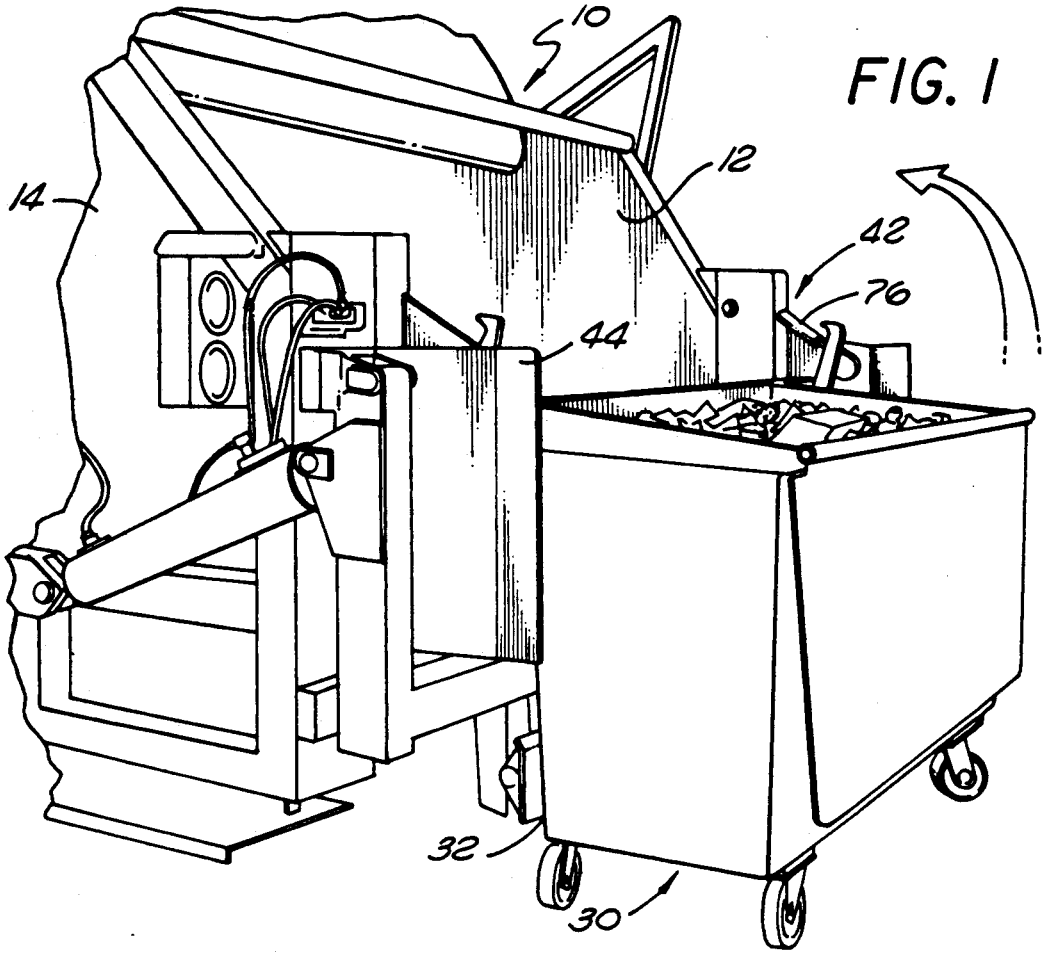
FIG. 1 is a fragmentary perspective view of a hopper in a rear end loader, a container for holding refuse and apparatus constituting one embodiment of the invention for transferring refuse from the container into the hopper.

The container 30 (FIG. 1) may be constructed in a conventional manner and may be provided with a vertically disposed rear wall 32 in a conventional manner. Pins 34 (FIGS. 5 and 6) extend horizontally from the front wall 32 at a position near the top of this vertical wall. The pins 34 may be disposed near the opposite lateral extremities of the front wall 32. In addition to its conventional construction, the container 30 may be provided with detent members 36 (FIGS. 8 and 9) at opposite lateral extremities of the rear wall 32 near the bottom of the rear wall. Each of the detent members 36 may have a raised ear 38 (FIGS. 8 and 9) at its outer end to define a depression 40 between the rear wall 32 and the raised ear.

Figure 2:
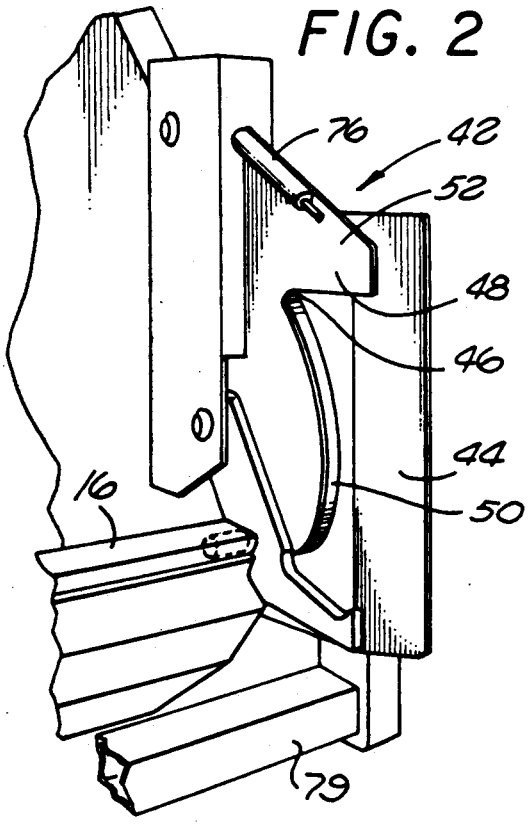
FIG. 2 is a fragmentary perspective view of a portion of the hopper in a rear end loader and of members included in the apparatus of this invention for holding a pin on the container in fixed position as a first step in obtaining the transfer of the refuse in the container into the hopper.

Apparatus generally indicated at 42 is associated with the refuse equipment 10 and the container 12 for transferring refuse from the container into the hopper 14. The apparatus 42 includes a pair of obliquely sloped posts 44 laterally spaced to receive the pins 34 and to guide the container into a proper position between the posts. In one position of the container 30, the pins 34 become disposed in recesses 46 (FIGS. 2 and 4) in a retaining member 48. The recesses 46 are defined at a common position between a convexly curved surface 50 at the bottom of the retaining member 48 and a top portion 52 of the retaining member.

Figure 3:
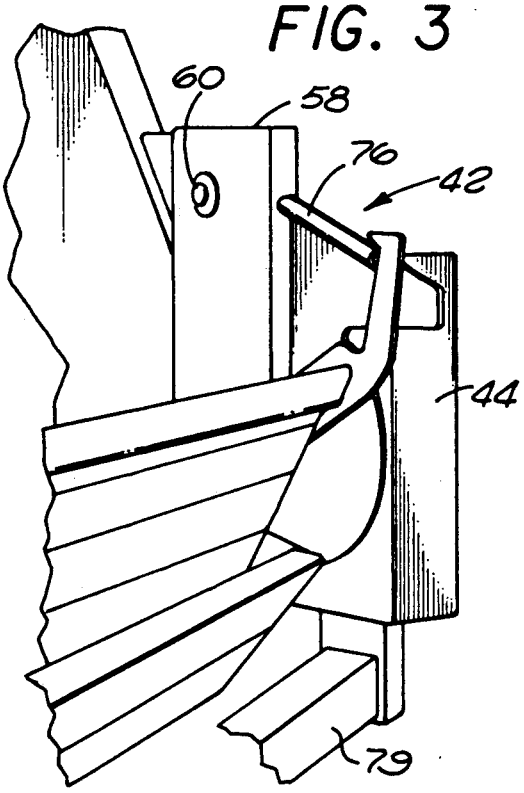
FIG. 3 is a fragmentary perspective view similar to that shown in FIG. 2, with the members in position for fixedly holding the pin on the container as a first step in obtaining the transfer of the refuse in the container into the hopper.
Figure 4:
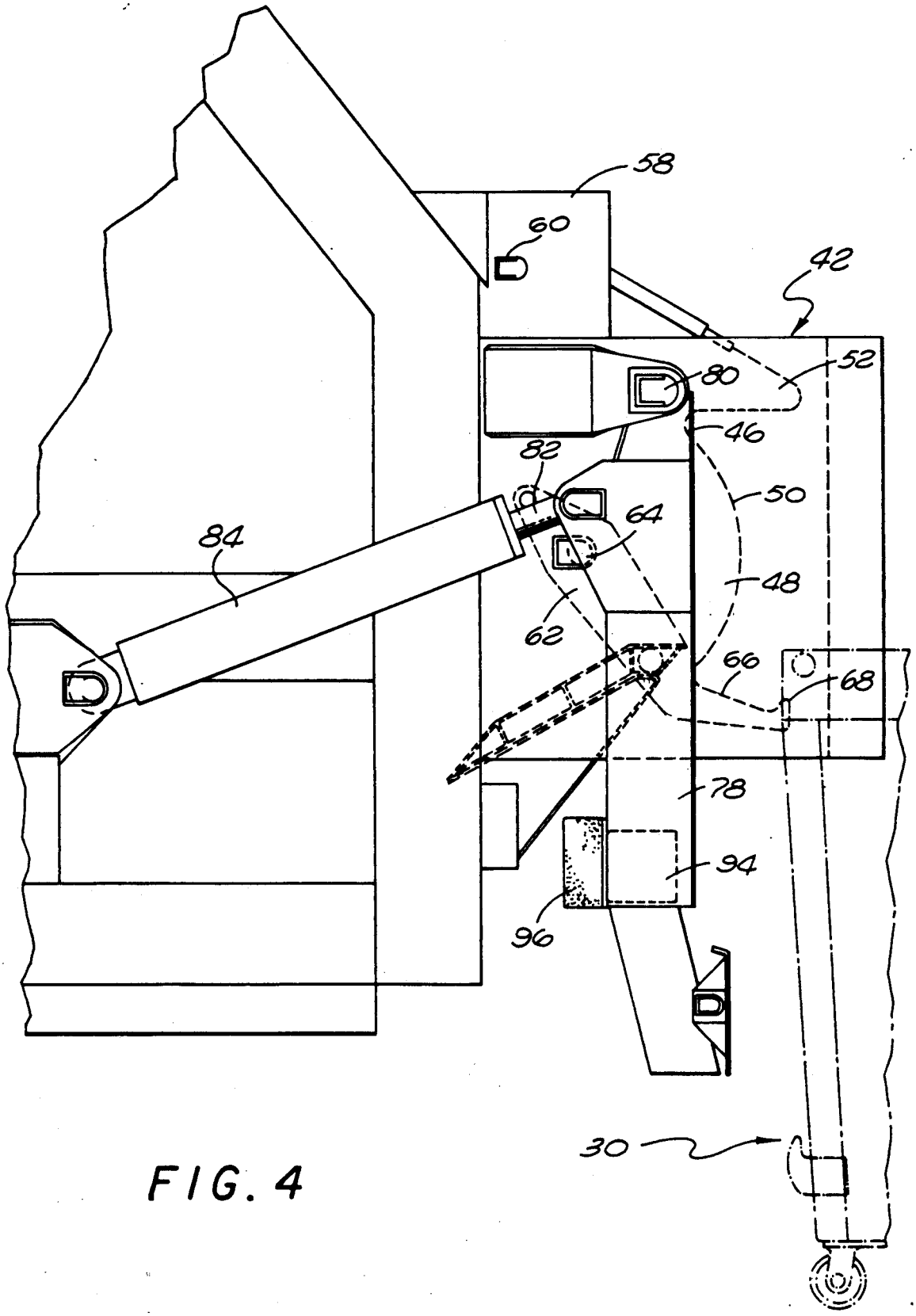
FIG. 4 is an enlarged fragmentary side elevational view of the hopper in the rear end loader, the container and the apparatus of this invention with the apparatus in position for receiving the container.

The retaining members 48 may be attached as by welding to a pair of laterally spaced stanchions 58 (FIGS. 3 and 4). The stanchions 58 may be suitably welded to the side walls of the hopper 14 in the refuse equipment 10. Actuating members 62 (FIGS. 4 and 5) may be attached as by pivot pins 64 to the stanchions 58 for pivotal movement relative to the stanchions. The actuating members 62 may be provided with arms 66 for engaging the pins 34 and moving the container 30 upwardly so that the pins are retained by the gripping members 48 and the actuating members in the recesses 46.

Rods 70 (FIGS. 5 and 6) associated with hydraulic cylinders 72 are attached to the upper ends of the actuating members 62 as at 73 to pivot the actuating members about the pivot pins 64 as a fulcrum when the rods are extended or retracted. When the rods 70 are extended, the actuating members 62 are pivoted in a counterclockwise direction on an axis defined by the pins 64. The arms 66 on the actuating members 62 then pivot the pins 34 of the container 30 to raise the container from the ground. The arms 66 then move the pivot pins 34 into the recess 46 in the gripping members 48 as best seen in FIG. 3. In this position, the pivot pins 34 are fixedly held between the arms 66 of the actuating members 62 and the convexly curved surfaces 50 of the retaining members 48. It will be appreciated that this retention will be effective even if the pins 34 are not in the recesses 46 in the gripping members 48. For example, such retention may be provided when the pivot pins 34 are at any position along a surface 49 defining the bottom of the gripping members 48.

Limit switch 76 (FIGS. 1-3) is disposed on the stanchion 58 to be operated by the arms 66 when the arms have been pivoted through a particular angle. These limit switches are also shown in FIG. 10. When the limit switches 76 are operated, the pivotal movement of the actuating members 62 is discontinued. During the pivotal movement of the actuating members 62, the guide structure 22 is moved upwardly from the position shown in broken lines at 26 in FIG. 6 to the position indicated in solid lines in FIG. 6.

Support members 78 are suitably attached to the refuse equipment and are pivotable relative to the refuse equipment on pins 80 (FIG. 7) as a fulcrum. The support members 78 are pivotably driven by rods 82 associated with hydraulic cylinders 84. When the rods 82 are extended, the support members 78 are pivoted in a counterclockwise direction. The front wall 32 of the container 30 is disposed against the support members 78 so as to be pivoted in the counterclockwise direction with the support members. The support members are joined by a roll bar 79. The roll bar 79 operates to provide for a movement of the support members 78 in unison, thereby preventing one of the support members from being cocked relative to the other support member.

Since the pivot pins 34 are retained in the recess 46, the container 30 pivots about the pivot pins 34 as a fulcrum. This causes the bottom of the container 30 to become disposed at a position above the top of the container with a continued rotation of the support members 78 in a counterclockwise direction When this occurs, the refuse in the container 30 starts to become transferred into the hopper 14 in the refuse equipment 10. This transfer is facilitated by the disposition of the guide members 22 in the position indicated in solid lines in FIG. 6.

To facilitate the proper disposition of the rear wall 32 of the container 30 against the support members 78, shoes 88 (FIGS. 8 and 9) may be disposed on the support members 78 near the bottom of the support members and may be adaptable in position relative to the support members. This adaptability may be obtained by pivotably attaching the shoes 88 to the support members 78 as by pivot members 90. By providing the shoes 88 with a pivotable relationship with respect to the support members 78, the shoes 88 become adapted in position so that they are disposed in flat relationship against the front wall 32 of the container 30.

The shoes 88 may be provided with a relatively great dimension in the vertical direction so that the forces imposed by the shoes against the container are distributed over a large area. This prevents the container 30 from becoming deformed in any way when the container is pivoted upwardly by the support members 78 in a counterclockwise direction.

As will be seen in FIG. 4, the pivot pins 80 controlling the pivotal movement of the support members 78 are disposed slightly above the recesses 46 in which the pivot pins 34 on the containers 30 are retained. Because of this, there is a relatively small displacement between the support members 78 and the container 30 as the support members and the container 30 are pivoted upwardly in the counterclockwise direction by the pivotal movement of the support members 78. This displacement causes the shoes 88 to move upwardly into the depressions 40 defined by the front wall 32 of the container 30 and the detent members 36. This retention of the shoes 88 in the depressions 40 helps to prevent the container from falling into the hopper 14 when the container has been raised to the position shown in FIG. 9.

After the refuse in the container 30 has been transferred into the hopper 14, the support members 78 and the container are pivoted in a clockwise direction to lower the position of the container. During the lowering of the container, the shoes 82 become disengaged from the depressions 40. When the support members 78 have been rotated through a particular distance, one of the support members actuates a limit switch 94 (FIG. 4) on a stop member 96. The stop member 96 limits the downward movement of the support members 76. The actuating members 62 then become rotated as a result of the actuation of the limit switch 94 in a clockwise direction to lower the container 30 to the ground.

FIG. 10 illustrates the electrical circuitry for controlling the operation of the apparatus described above. The purpose of the electrical circuit is to provide safety by not allowing the container to be accidentally moved to undesirable positions. The electrical circuit controls the flow of oil to the hydraulic circuit by activating a solenoid operated PTO, a dry valve, or a dump valve. The circuit also energizes the solenoid valve that raises and lowers the Lock Arms.

In the electrical circuit, switches are placed as follows (Letters refer to the enclosed sketch):

Limit switches 76A and 76B are closed by each of the two lock arms 66. They insure that both lock arms 66 are in the locked position before the container can be dumped. A valve switch 100 is disposed on the hydraulic valve for the roll bar 79 and is closed when the valve is actuated to lower the roll bar 79. This insures that the roll bar 79 can always be returned to the down position.

The switch 94 is located on the roll bar stops 96 and is closed when the roll bar is in the down position. This switch makes sure that the lock arms 66 can only be lowered to the unlocked position if the roll bar 79 is in the down position.

An operator controlled switch 102 is located on the side of the hopper and controls the up and down movement of the lock arms 66. Solenoids 104 and 106 operate the valve for the lock arms 66 and are energized by this switch.

The operation of the apparatus described above and shown in FIGS. 1-9 begins after the PTO Rocker switch has been turned on and the truck has been backed into the container. Limit switches 76A and 76B are open because the lock arms 66 are in the down position. Limit switch 100 is open because the roll bar 79 is not being lowered, and limit switch 94 is closed because the roll bar 79 is in the down position. Switch 94 is closed, allowing oil to be provided to the hydraulic system. Switch 102 is in the neutral position and is operator controlled.

To dump the container, the lock arms 66 are first raised. To raise the lock arms 66, the latch actuator switch 102 is held by the operator in the up position. This causes the solenoid 104 to be energized and the hydraulic control valve to be shifted, raising the lock arms 66. A diode 108 is included to ensure that the PTO solenoid gets power when the switch 102 is held by the operator in the up position to raise the lock arms The diode 106 is included to prevent the solenoid 104 from being energized every time that the PTO solenoid is energized but to allow the operator to raise the lock arms at any time.

When the lock arms 66 reach the locked position, the operator releases the switch 104. Power is supplied to the PTO solenoid because the lock arms 66 are in the locked position, closing the limit switches 76A and 76B. Power is also supplied to the PTO solenoid through the switch 94, which is closed, because the roll bar 79 has not been raised yet.

Dumping the container 30 is accomplished by the operator shifting the roll bar valve to the raise position. As the roll bar 79 starts to rise, the switch 94 is opened, but switches 76A and 76B are still closed. This causes the PTO solenoid to remain energized. With the switch 94 open, even if the operator were to hold the switch 102 in the down position, the lock arms will not lower. The solenoid 106, which shifts the valve to lower the arms, can not be energized since no power is being supplied to the switch 94. Thus, the lock arms 66 will not lower. This is important because, if the operator could lower the arms 66 at this time, the container 30 could fall to the ground uncontrolled.

After the container 30 is dumped, the roll bar 79 is returned to the down position by the operator shifting the roll bar valve to the down position. This lever closes the switch 100, which supplies power to the PTO solenoid. This switch allows the roll bar 79 to be lowered at any time. As the roll bar 79 reaches the down position, the switch 94 closes, and the switch 100 opens after the operator releases the roll bar down lever.

To release the container 30, the operator holds the switch 102 in the down position. With the switch 94 closed, the solenoid 106 is energized, causing the hydraulic control valve to shift and the lock arms 66 to lower. After both lock arms 66 have reached the down position, the truck may pull away from the container.

The apparatus constituting this invention has certain important advantages. It provides an initial rotation of the container 30 to a position where the pin 34 on the container becomes locked in position to prevent the container from being dislodged from such apparatus. The apparatus then provides a further rotation of the container 30, with the pin 34 on the container in this locked relationship, to a position where the refuse in the container becomes transferred into the refuse equipment. The apparatus is constructed to lift heavy containers with heavy loads of refuse in such containers without imposing any undue burdens on such apparatus.

The apparatus constituting this invention also has other advantages of some importance. For example, it is able to dump the refuse in the containers 30 into the hopper 14 of the refuse equipment so without having to attach any cable or chain to the containers. It also provides such dumping of refuse into the hopper 14 without the production of noise associated with the apparatus of the prior art. It additionally provides such dumping without abusing the containers 30. This causes the containers to have a long life.

There are other important advantages to the apparatus of this invention. The movement of the guide structure 22 to the position shown in solid lines in FIG. 6 causes the volume of the hopper 14 to be effectively increased. This allows refuse from an increased number of the container 30 to be dumped into the hopper 14 without having to cycle the refuse into the storage body of the refuse equipment.

There is another important advantage to the apparatus of this invention. This results from the fact that the containers 30 are held in position by the retention of the pivot pins 34 in the recess 46, formed by the arm 66 and ear 48. Even if the arms 66 should drift downward because of hydraulic leakage or other reasons, the recess becomes larger but still retains the pivot pins 34, preventing the container 30 from coming loose and injuring the operator or a bystander.

The apparatus of this invention is also advantageous in that the containers 30 do not have to be manually moved into position in order for the apparatus to become operative. This results from the positioning of the containers relative to the obliquely disposed posts 44. The apparatus is also advantageous in that it has no pinch points which can cause an operator or a bystander to be injured if that person should have a hand or an arm at such pinch point while the apparatus is operating.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination for use with a container for holding refuse and for depositing the refuse into a hopper through an opening at the rear end of the hopper, the container having a pin and having a lid at the top of the container and also having a peripheral wall extending downwardly from the lid, first means constructed for coupling to the rear end of the hopper for engaging the peripheral wall of the container near the top of the container and for pivoting the bottom of the container upwardly about the pin on the container, second means disposed relative to the first means for cooperating with the first means to retain the pin on the container in a fixed relationship when the first means pivots the container upwardly, and third means independent in its movement of the movement of the first means and responsive only to the cooperative retention by the first and second means of the pin on the container in the fixed relationship for pivoting the container to a position where the bottom of the container is above the top of the container and is facing in a direction relative to the top of the container and the hopper to provide for the transfer of the refuse from the container into the hopper.

2. In a combination as set forth in claim 1 wherein the hopper has a lip defining the bottom of the opening at the rear end of the hopper, means movable with the first means to a position relative to the lip of the hopper and the top of the container for guiding the refuse into the hopper during the transfer of the refuse from the container into the hopper.

3. In combination for use with a container for holding refuse and for depositing the refuse into a hopper through an opening at the rear end of the hopper, the container having a pin and having a lid at the top of the container and also having a peripheral wall extending downwardly from the lid, a first pivot pin, first means mounted on the first pivot pin for rotary movement, the first means being constructed to engage the peripheral wall of the container at the top of the container and rotate the bottom of the container upwardly about the first pivot pin, second means disposed relative to the first means and shaped to trap the pin on the container between the first means and the second means upon the rotation of the bottom of the container upwardly by the first means about the first pivot pin and to hold the pin on the container in fixed position between the first means and the second means, a second pivot pin, and third means mounted on the second pivot pin and responsive to the fixed positioning of the pin on the container between the first means and the second means for rotating the container about the pin on the container to a position where the bottom of the container is above the lid of the container for the transfer of the refuse from the container into the hopper.

4. In a combination as set forth in claim 3, fourth means associated with the third means for locking the bottom of the container to the third means during the rotary movement of the container by the third means to lift the bottom of the container above the lid of the container.

5. In a combination as set forth in claim 4, fifth means movable in response to the movement of the first means for providing a guide for the movement of the refuse from the container into the hopper when the bottom of the container has been lifted by the third means to a position above the lid of the container.

6. In a combination as set forth in claim 5, the first and second pivot pins being disposed in close proximity and the second pivot pin being disposed above the first pivot pin to provide for the movement of the fourth means into locking relationship with the bottom of the container when the third means pivots the bottom of the container above the lid of the container.

7. In combination for use with a container for holding refuse and for depositing the refuse into a hopper through an opening at the rear end of the hopper, the container having a pin and also having a peripheral wall, the hopper having a lip defining the bottom of the opening and also having a bottom wall extending from the lip, first means disposed relative to the container for pivoting the container through a first particular angle and for locking the pin of the container to the first means after such rotation, second means disposed relative to the container and responsive to the rotation of the container through the first particular angle for pivoting the container through a second particular angle to dispose the bottom of the container above the lid of the container, and third means movable with the first means and cooperative with the hopper to redefine the lip of the hopper and to effectively extend the bottom wall of the hopper to the redefined lip to facilitate the transfer of the refuse from the container into the hopper when the bottom of the container is above the lid of the container.

8. In a combination as set forth in claim 7 including guide means disposed within the hopper and included within the third means and movable to a position, in accordance with the movement of the first means, for facilitating the transfer of the refuse in the container into the refuse equipment.

9. In a combination as set forth in claim 8, fourth means associated with the second means and adaptable to conform the peripheral wall of the container during the rotation of the container through the second particular angle, the fourth means also being operative to grip the container during the rotation of the container through the second particular angle.

10. In a combination as set forth in claim 9 wherein the container has a detent member and the fourth means cooperates with the detent member during the rotation of the container through the second particular angle to retain the container in fixed position.

11. In a combination as set forth in claim 7, guide means disposed within the hopper and associated with the first means and movable to a position, in accordance with the movement of the first means, for facilitating the transfer of the refuse in the container into the refuse equipment.

* * * * *